US009499377B2

(12) United States Patent
Shen et al.

(10) Patent No.: US 9,499,377 B2
(45) Date of Patent: Nov. 22, 2016

(54) ADJUSTABLE HYDRAULIC JACK WITH A SLIDER LOCKING STRUCTURE

(71) Applicant: CHANGSHU TONGRUN AUTO ACCESSORY CO., LTD., Jiangsu (CN)

(72) Inventors: Min Shen, Jiangsu (CN); Xiaoming Shi, Jiangsu (CN)

(73) Assignee: CHANGSHU TONGRUN AUTO ACCESSORY CO., LTD., Jiangsu (CN)

( * ) Notice: Subject to any disclaimer, the term of this patent is extended or adjusted under 35 U.S.C. 154(b) by 123 days.

(21) Appl. No.: 14/331,104

(22) Filed: Jul. 14, 2014

(65) Prior Publication Data

US 2015/0175394 A1 Jun. 25, 2015

(30) Foreign Application Priority Data

Dec. 23, 2013 (CN) ..... 2013 1 0716654

(51) Int. Cl.
*B66F 3/24* (2006.01)
*B66F 5/04* (2006.01)
*B66F 3/38* (2006.01)

(52) U.S. Cl.
CPC .. *B66F 5/04* (2013.01); *B66F 3/38* (2013.01)

(58) Field of Classification Search
USPC ..... 254/63 R, 93 R
See application file for complete search history.

(56) References Cited

U.S. PATENT DOCUMENTS

| | | | | |
|---|---|---|---|---|
| 3,907,252 | A * | 9/1975 | Gaarder | B66F 5/04 254/124 |
| 4,289,298 | A * | 9/1981 | Kameda | B66F 5/04 254/8 B |
| 4,513,950 | A * | 4/1985 | Yamagishi | B66F 5/04 254/8 B |
| 7,434,782 | B2 * | 10/2008 | Arzouman | B66F 13/00 254/134 |
| 2003/0218159 | A1 * | 11/2003 | Arzouman | B66F 13/00 254/8 B |
| 2005/0035337 | A1 * | 2/2005 | Hung | B66F 5/04 254/8 B |
| 2008/0083913 | A1 * | 4/2008 | Fang | B66F 5/04 254/8 B |
| 2013/0153839 | A1 * | 6/2013 | Shen | B66F 5/04 254/2 B |

FOREIGN PATENT DOCUMENTS

| | | |
|---|---|---|
| CN | 101691194 B | 4/2010 |
| CN | 202358873 U | 8/2012 |

* cited by examiner

*Primary Examiner* — Alvin Grant
(74) *Attorney, Agent, or Firm* — Christensen Fonder P.A.

(57) ABSTRACT

An adjustable hydraulic jack with a slider locking structure that includes a chassis, hydraulic assembly, boom assembly, and handle lever. The boom assembly includes a bracket, a fore arm, and a rear arm. The bracket includes a pull handle, left and right bracket side-plates, and a bracket-fixing pin. The bracket is connected to one end of the fore arm, the other end of the fore arm is connected to one end of the rear arm, and the other end of the rear arm is connected to the chassis. The left and right bracket side-plates have left and right side-plate sockets on their respective bottoms; the fore arm has left and right sliding chutes and a spring-loaded fixing pin fixed on its upper end. A slider locking device is arranged between the bracket and the fore arm, and includes left and right sliders, a spring and at least one pin shaft.

8 Claims, 2 Drawing Sheets

ADJUSTABLE HYDRAULIC JACK WITH A SLIDER LOCKING STRUCTURE

PRIORITY CLAIM

The present application claims priority to Chinese Patent Application No. 201310716654.X, filed on Dec. 23, 2013, which said application is incorporated by reference in its entirety herein.

FIELD OF THE INVENTION

The present invention belongs to the technical field of lifting apparatuses, and in particular relates to an adjustable hydraulic jack with a slider locking structure, which is an improvement to the boom structure on existing horizontal hydraulic jacks.

BACKGROUND OF THE INVENTION

At present, horizontal hydraulic jacks commonly seen in the market mainly comprise a chassis, a hydraulic assembly, a boom assembly, a link rod, and a handle lever, wherein, the boom assembly comprises a boom and a bracket arranged on the boom, one end of the link rod is pivotally jointed to the chassis, and the other end of the link rod is pivotally jointed to the bracket of the boom assembly. In the lifting process, as the handle lever is pressed repeatedly, the hydraulic assembly drives the boom assembly to lift up, and finally the bracket on the boom jacks up the heavy load. The structure described above has the following drawback: for a horizontal hydraulic jack with same specification, i.e., the parameters such as oil pressure and stroke are specific, both the lifting height and the load capacity are fixed and can not be changed because both the boom length and the link rod length can not be adjusted; therefore, such a horizontal hydraulic jack is very simple in functionality and has limited applicability. To solve the above problems, a hydraulic jack in which the height and load at the lowest operating position can be changed effectively by adjusting the boom length and the link rod length under the condition of equivalent parameters. For example, in Chinese Invention Patent Publication No. CN101691194B, an "adjustable horizontal hydraulic jack" is disclosed, in which the transition between different states of boom position is implemented with a fixing pin; specifically, when the fixing pin is used to fix the bracket and fore arm, the boom and the link rod are in a folded position state; whereas, when the fixing pin is used to fix the fore arm and rear arm, the boom and the link rod are in normal position state. However, utilizing a fixing pin to change the position state of the boom is complicated in operation, and has potential safety risks in actual application. For another example, in Chinese Utility Model Patent Publication No. CN202358873U, a "Boom-Adjustable Horizontal Hydraulic Jack with a Pull Lock Mechanism" is disclosed, in which the transition between different states of boom position is implemented with a pull lock mechanism; however, the pull lock mechanism is mounted on the bracket and they are at the same elevation; consequently, when the boom jacks up, it may hit on the pull lock mechanism easily if the operation is inappropriate, causing damage to the pull lock mechanism and degraded service life of the lifting jack. In addition, such a structure is high in fabrication cost and difficult to assemble.

SUMMARY OF THE INVENTION

An object of the present invention is to provide an adjustable hydraulic jack with a slider locking structure, which is simple in structure, easy to assemble, low in cost, easy and safe to operate, can act reliably, and has a long service life.

The object of the present invention is attained as follows: an adjustable hydraulic jack with a slider locking structure, comprising a chassis, a hydraulic assembly, a boom assembly, and a handle lever, wherein, the boom assembly comprises a bracket, a fore arm, and a rear arm; the bracket comprises a pull handle, a left bracket side-plate, a right bracket side-plate, and a bracket fixing pin, and is pivotally jointed to one end of the fore arm via the bracket fixing pin, the other end of the fore arm is pivotally jointed to one end of the rear arm via a connecting shaft, and the other end of the rear arm is pivotally jointed to the chassis, wherein, the left bracket plate has a left side-plate socket with a downward opening on its bottom in the height direction, and the right bracket side-plate has a right side-plate socket with a downward opening on its bottom in the height direction; the fore arm has a left sliding chute and a right sliding chute arranged in symmetry on its left side and right side, and has a spring-loaded fixing pin fixed on its upper end in the height direction; a slider locking device is arranged between the bracket and the fore arm, and comprises a left slider, a right slider, a spring, and at least one pin shaft, the pin shaft is inserted in the left sliding chute and right sliding chute and can move up and down in the two sliding chutes, the two ends of the pin shaft are connected to the left slider and right slider respectively, the left slider aligns to the left side-plate socket and can fit with the left side-plate socket, the right slider aligns to the right side-plate socket and can fit with the right side-plate socket, one end of the spring is connected to the spring-loaded fixing pin, and the other end of the spring is connected to the pin shaft.

In an embodiment of the present invention, the right side-plate socket corresponds to the left side-plate socket in position, and both of them have a U-shaped opening.

In another embodiment of the present invention, the left sliding chute and right sliding chute are long rectangular channels.

In another embodiment of the present invention, the fore arm has two left slider fixing bases fixed on the two sides of the left sliding chute in the width direction of the left sliding chute, and a slideway in which the left slider can slide up and down is formed between the pair of left slider fixing bases; the fore arm has two right slider fixing bases fixed on the two sides of the right sliding chute in the width direction of the right sliding chute, and a slideway in which the right slider can slide up and down is formed between the pair of right slider fixing bases.

In another embodiment of the present invention, one end of the spring is connected at a position near the center of the spring-loaded fixing pin in the length direction of the spring-loaded fixing pin, and the other end of the spring is connected to a position near the center of the pin shaft in the length of the pin shaft.

In another embodiment of the present invention, the two ends of the pin shaft are removably connected with the left slider and right slider via fasteners.

In another embodiment of the present invention, the pin shaft is preferably in a quantity of two, which are arranged at specific spacing in a vertical direction.

In another embodiment of the present invention, the fore arm has a hook formed on the tip of one end where the fore arm is connected with the rear arm, the rear arm has a lock pin mounted on one end where the rear arm is connected with the fore arm to engage the hook.

In the present invention, since a slider locking device is arranged between the bracket and the fore arm, when the slider locking device is pressed down, the pin shaft will be driven to press down with the slider locking device, and thereby the left slider and right slider will disengage from the left side-plate socket on the left bracket side-plate and the right side-plate socket on the right bracket side-plate respectively; consequently, the bracket and the fore arm will be unlocked from each other, the fore arm and the rear arm can be set level by virtual of the engagement between the hook and the lock pin, and the boom assembly will be in a normally deployed position state; to transit the boom assembly from deployed position state to folded position state, the pin shaft can be driven with the spring to move upwards in the left sliding chute and right sliding chute, and thereby the left slider and right slider connected to the pin shaft will be driven to move upwards with the pin shaft and automatically fit into the left side-plate socket and right side-plate socket respectively, so that the bracket and the fore arm form a fixed connection between them. Hence, the lifting jack in the present invention has advantages such as simple structure, easy assembly, low cost, easy and safe operation, reliable action, and long service life.

Figure 1:
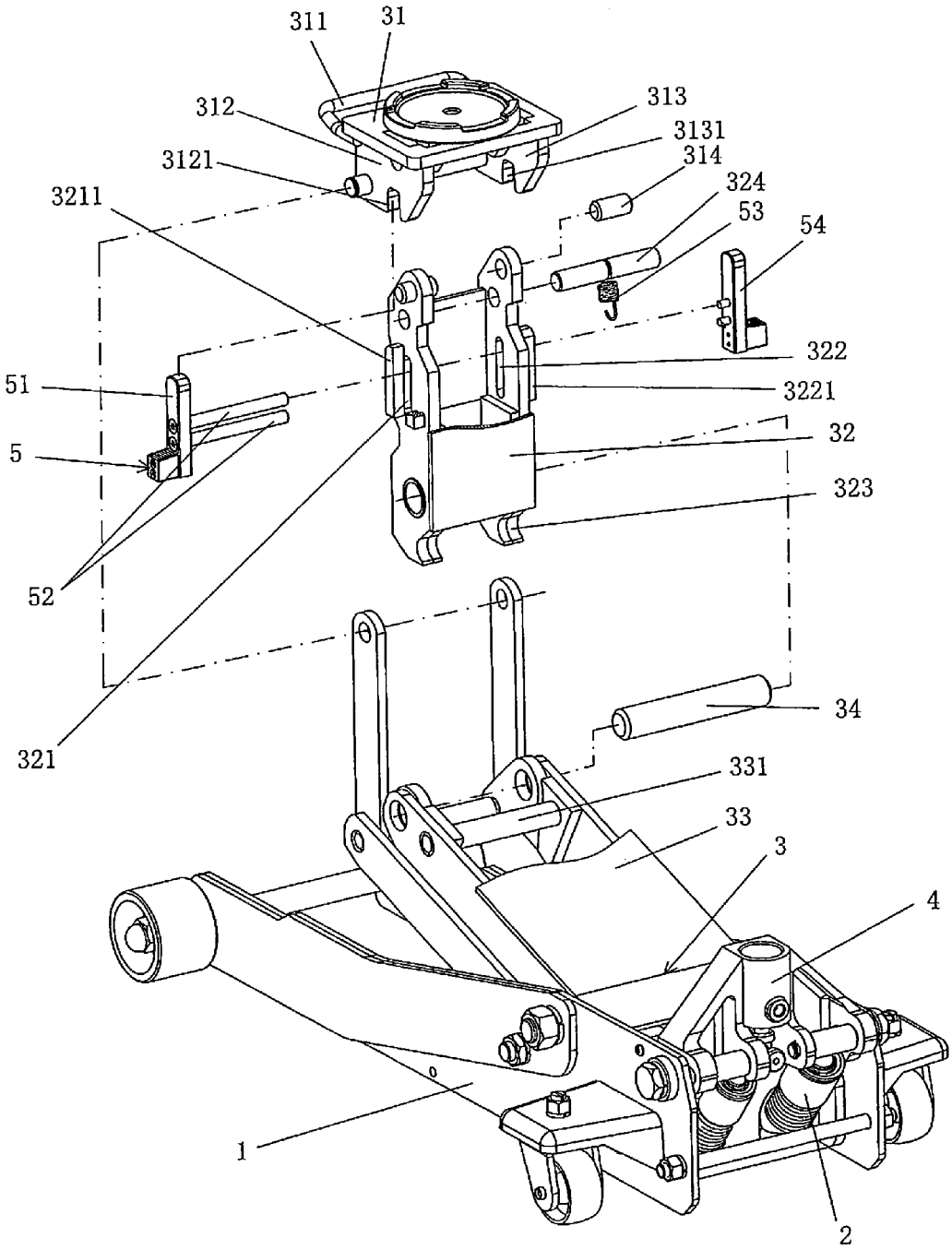
FIG. 1 is a 3D exploded view of an embodiment of the present invention.

The following reference numerals are used in the drawings to refer to the respective components: 1. chassis; 2. hydraulic assembly; 3. boom assembly, 31. bracket, 311. pull handle, 312. left bracket side-plate, 3121. left side-plate socket, 313. right bracket side-plate, 3131. right side-plate socket, 314. bracket fixing pin; 32. fore arm, 321. left sliding chute, 3211. left slider fixing base, 322. right sliding chute, 3221. right slider fixing base, 323. hook, 324. spring-loaded fixing pin; 33. rear arm, 331. lock pin, 34. connecting shaft; 4. handle lever; 5. slider locking device, 51. left slider, 52. pin shaft, 53. spring, 54. right slider

DETAILED DESCRIPTION OF THE EMBODIMENTS

To facilitate understanding of the technical essence and beneficial effects of the present invention more clearly, hereunder, embodiments of the present invention will be described with reference to the accompanying drawings. However, the description of the embodiments shall not be deemed as constituting any limitation to the technical solution of the present invention. Any equivalent but non-substantive modification or variation made without departing from the concept and spirit of the present invention shall be deemed as falling into the protection scope of the present invention.

Figure 2:
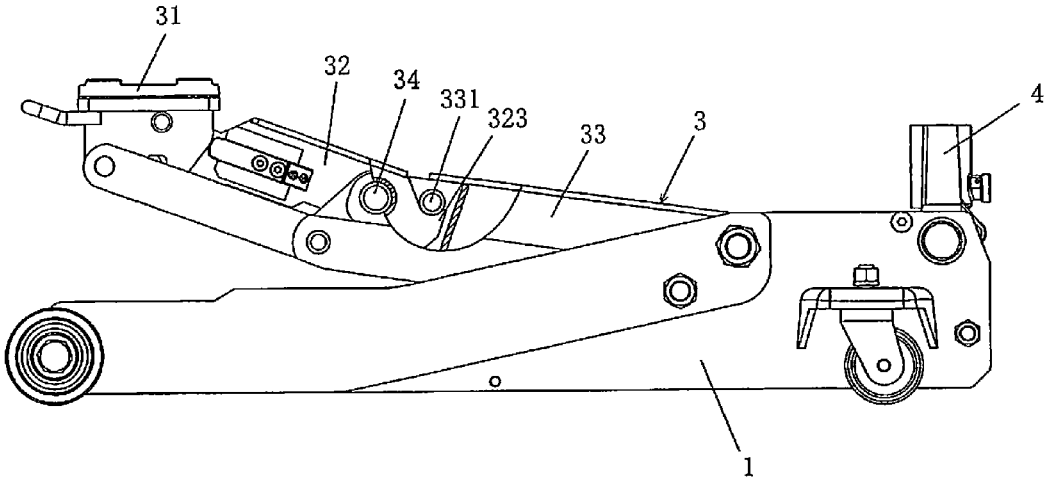
FIG. 2 is a 3D structural diagram of the boom assembly in the embodiment shown in FIG. 1 in a normally deployed position state.
Figure 3:
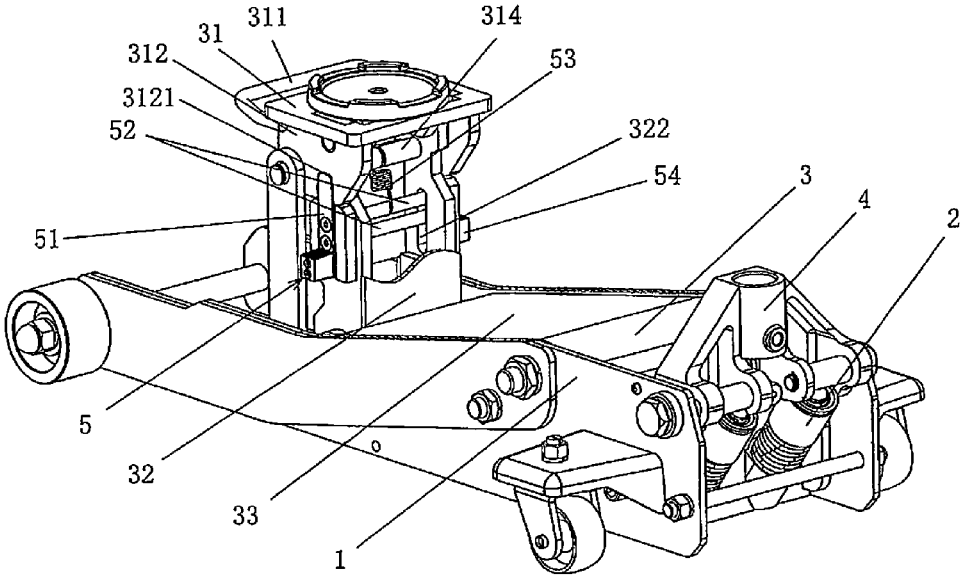
FIG. 3 is a 3D structural diagram of the boom assembly in the embodiment shown in FIG. 1 in a folded position state.

Referring to FIG. 1, in conjunction with FIG. 2 and FIG. 3, the present invention relates to an adjustable hydraulic jack with a slider locking structure, comprising a chassis 1, a hydraulic assembly 2, a boom assembly 3, and a handle lever 4. The boom assembly 3 comprises a bracket 31, a fore arm 32, and a rear arm 33, wherein, the bracket 31 comprises a pull handle 311, a left bracket side-plate 312, a right bracket side-plate 313, and a bracket fixing pin 314, the bracket 31 is pivotally jointed to one end of the fore arm 32 via the bracket fixing pin 314, the other end of the fore arm 32 is pivot-jointed to one end of the rear arm 33 via a connecting shaft 34, the other end of the rear arm 33 is pivotally jointed to the chassis 1, the left bracket side-plate 312 has a left side-plate socket 3121 with a downward opening on its bottom in the height direction, the right bracket side-plate 313 has a right side-plate socket 3131 with an downward opening on its bottom in the height direction, and the right side-plate spigot 3131 corresponds to the left side-plate socket 3121 in position. The fore arm 32 has a left sliding chute 321 and a right sliding chute 322 arranged in symmetry at the left side and right side of the fore arm 32, and has a spring-loaded fixing pin 324 fixed on its upper end in height direction. A slider locking device 5 is arranged between the bracket 31 and the fore arm 32, and comprises a left slider 51, a right slider 54, a spring 53, and at least one pin shaft 52, wherein, the pin shaft 52 is inserted in the left sliding chute 321 and the right sliding chute 322 and can move up and down in the two sliding chutes, the two ends of the pin shaft 52 are connected to the left slider 51 and the right slider 54 respectively, the left slider 51 aligns to the left side-plate socket 3121 and can fit with the left side-plate socket 3121, the right slider 54 aligns to the right side-plate socket 3131 and can fit with the right side-plate socket 3131, one end of the spring 53 is connected to the spring-loaded fixing pin 324, and the other end of the spring 53 is connected to the pin shaft 52. Here, it should be noted that the locking purpose can also be attained when either of the left slider 51 and right slider 54 in the slider locking device 5 is used, rather than using both of them. However, such an application method is also within the intended scope of protection of the technical solution.

The right side-plate socket 3131 corresponds to the left side-plate socket 3121 in position, and there is no restriction on the shape of the two sockets in the present invention. In this embodiment, the two sockets preferably have a U-shaped opening respectively.

Likewise, there is no restriction on the shape of the left sliding chute 321 and right sliding chute 322. In this embodiment, the left sliding chute 321 and right sliding chute 322 are long rectangular channels.

The fore arm 32 has two left slider fixing bases 3211 fixed on the two sides of the left sliding chute 321 in the width direction of the left sliding chute 321, and a slideway designed to guide the left slider 51 to slide up and down in it is formed between the pair of left slider fixing bases 3211; the fore arm 32 has two right slider fixing bases 3221 fixed on the two sides of the right sliding chute 322 in the width direction of the right sliding chute 322, and a slideway designed to guide the right slider 54 to slide up and down in it is formed between the pair of right slider fixing bases 3221.

The spring 53 can be a tension spring, compression spring, or any other return mechanism, as long as it can implement self-return of the spring 53. There are no restriction on the connecting positions between the two ends of the spring 53 and the spring-loaded fixing pin 324 and pin shaft 52. In this embodiment, one end of the spring 53 is connected to a position near the center of the spring-loaded fixing pin 324 in the length direction of the spring-loaded fixing pin 324, and the other end of the spring 53 is connected to a position near the center of the pin shaft 52 in the length direction of the pin shaft 52.

There is no restriction on the form of connections between the two ends of the pin shaft 52 and the left slider 51 and right slider 54. In this embodiment, fasteners (e.g., screws or bolts, etc.) are used to form removable connections.

There is no restriction on the quantity of the pin shaft 52. In this embodiment, the pin shaft 52 is preferably in a quantity of two, which are arranged at specific spacing in a vertical direction.

The fore arm 32 has a hook 323 formed on the tip of one end where the fore arm 32 is connected with the rear arm 33, and the rear arm 33 has a lock pin 331 mounted on one end where the rear arm 33 is connected with the fore arm 32 to engage the hook 323.

Referring to FIG. 1, together with FIG. 2 and FIG. 3, now, the working principle of the present invention will be described. When the slider locking device 5 is pressed down, the pin shaft 52 will be driven to move down with the slider locking device 5, and thereby the upper ends of the left slider 51 and right slider 54 will disengage from the left side-plate socket 3121 on the left bracket side-plate 312 and the right side-plate socket 3131 on the right bracket side-plate 313 respectively; consequently, the bracket 31 and the fore arm 32 will be unlocked from each other, and the fore arm 32 can rotate in a counter-clockwise direction around the connecting shaft 34, until the hook 323 on the fore arm 32 engages the lock pin 331; after the engagement, the fore arm 32 and the rear arm 33 can be set level, and thereby the boom assembly 3 will be in normally deployed position state (as shown in FIG. 2); in the normally deployed position state, the hydraulic jack can jack up a light-load and low-chassis automobile, such as a sedan car. To switch the boom assembly from deployed position state to folded position state, first, the fore arm 32 should be driven to rotate in clockwise direction around the connecting shaft 34 to an upright position; then, the pin shaft 52 should be driven with the spring 53 to move upwards in the left sliding chute 321 and right sliding chute 322; thus, the left slider 51 and right slider 54 that are connected to the pin shaft 52 will be driven to move upwards in the slideway formed between the left slider fixing base 3211 and the right slider fixing base 3221 respectively, so that the upper ends of the left slider 51 and right slider 54 will automatically fit into the left side-plate socket 3121 and right side-plate socket 3131 respectively; thus, the bracket 31 and the fore arm 32 form a fixed connection between them, and the boom assembly 3 is in folded position state now, as shown in FIG. 3; when the boom assembly jacks up in the folded position state, it can jack up an automobile with heavier load and higher chassis, such as a Sports Utility Vehicle (SUV) or pick-up truck.

In summary, the technical solution provided in the present invention overcomes the drawbacks in the prior art and attains the object of invention, and has non-obvious technical effects.

The invention claimed is:

1. An adjustable hydraulic jack with a slider locking structure, comprising a chassis, a hydraulic assembly, a boom assembly, and a handle lever, the adjustable hydraulic jack defining a height and a height direction, wherein, the boom assembly comprises a bracket, a fore arm, and a rear arm; the bracket comprises a pull handle, a left bracket side-plate, a right bracket side-plate, and a bracket fixing pin, and is pivotally jointed to one end of the fore arm via the bracket fixing pin, the other end of the fore arm is pivotally jointed to one end of the rear arm via a connecting shaft, and the other end of the rear arm is pivotally jointed to the chassis, wherein, the left bracket plate at a bottom portion has a left side-plate socket with a downward opening in the height direction, and the right bracket side-plate at a bottom portion has a right side-plate socket with a downward opening in the height direction; the fore arm has a left sliding chute on a left-side portion and a right sliding chute on a right-side portion, the left sliding chute and the right sliding chute arranged in symmetry on the left side and right side portions, and has a spring-loaded fixing pin fixed on an upper end of the fore arm in the height direction; a slider locking device is arranged between the bracket and the fore arm, and comprises a left slider, a right slider, a spring, and at least one pin shaft, the pin shaft is inserted in the left sliding chute and right sliding chute and can move up and down in the left and right sliding chutes, a first end of the pin shaft is connected to the left slider and a second end of the pin shaft is connected to the right slider, the left slider aligns to the left side-plate socket and can fit with the left side-plate socket, the right slider aligns to the right side-plate socket and can fit with the right side-plate socket, one end of the spring is connected to the spring-loaded fixing pin, and the other end of the spring is connected to the pin shaft.

2. The adjustable hydraulic jack with a slider locking structure according to claim 1, wherein, the right side-plate socket corresponds to the left side-plate socket in position, and the right side-plate socket and the left side-plate socket each define a U-shaped opening.

3. The adjustable hydraulic jack with a slider locking structure according to claim 1, wherein, the left sliding chute and right sliding chute are long rectangular channels.

4. The adjustable hydraulic jack with a slider locking structure according to claim 1, wherein, the fore arm has two left slider fixing bases fixed on the two sides of the left sliding chute in a width direction of the left sliding chute, and a slideway in which the left slider can slide up and down is formed between the pair of left slider fixing bases; the fore arm has two right slider fixing bases fixed on the two sides of the right sliding chute in the width direction of the right sliding chute, and a slideway in which the right slider can slide up and down is formed between the pair of right slider fixing bases.

5. The adjustable hydraulic jack with a slider locking structure according to claim 1, wherein, one end of the spring is connected at a position near a center of the spring-loaded fixing pin in a length direction of the spring-loaded fixing pin, and another end of the spring is connected at a position near a center of the pin shaft in a length direction of the pin shaft.

6. The adjustable hydraulic jack with a slider locking structure according to claim 1, wherein, the first end of the pin shaft is removably connected to the left slider via a fastener, and the second end of the pin shaft is removably connected to right slider via another fastener.

7. The adjustable hydraulic jack with a slider locking structure according to claim 1, wherein, the pin shaft is preferably in a quantity of two, which are arranged at specific spacing in a vertical direction.

8. The adjustable hydraulic jack with a slider locking structure according to claim 1, wherein, the fore arm has a hook formed at a tip of one end where the fore arm is connected with the rear arm, and the rear arm has a lock pin mounted on one end where the rear arm is connected with the fore arm to engage the hook.

* * * * *